United States Patent [19]

Margolis

[11] Patent Number: 4,882,841

[45] Date of Patent: Nov. 28, 1989

[54] SPARK PRODUCER IN CONJUNCTION WITH A KNIFE

[76] Inventor: Peter I. Margolis, 1546 El Dorado Dr., Thousand Oaks, Calif. 91362

[21] Appl. No.: 310,856

[22] Filed: Feb. 15, 1989

[51] Int. Cl.[4] ..... B25F 3/00

[52] U.S. Cl. ..... 30/125; 7/118

[58] Field of Search ..... 30/125, 123; 7/118

[56] References Cited

U.S. PATENT DOCUMENTS 2,496,840 2/1950 Alexander ..... 30/125 X 2,651,106 9/1953 Breitzke ..... 30/125

*Primary Examiner*—Douglas D. Watts

*Assistant Examiner*—Willmon Fridie, Jr

*Attorney, Agent, or Firm*—Jack Munro

[57] ABSTRACT

The incorporating of a flint and a serrated striking surface in conjunction with a knife whether it is an exposed blade hunting knife or a packet knife where the blades can be moved to a non-exposed storage position. The flint is mounted within a carrier rod. This carrier rod is to be threadably secured within a storage chamber within a pivotable blade of the hunting knife or is mounted directly in the handle of an exposed blade knife. The flint and carrier rod can be disengaged from the storage chamber and manually operated against a striking surface to produce a spark to start a fire.

4 Claims, 2 Drawing Sheets

SPARK PRODUCER IN CONJUNCTION WITH A KNIFE

BACKGROUND OF THE INVENTION

The field of this invention relates to knives and more particularly to a modification to a knife which includes a device to start a fire eliminating the need for matches.

The ability to start a fire is desirable by outdoors individuals such as backpackers, hikers, and the like. The most common device to start a fire is a strikable match. Fires are desirable for campfires to produce heat and also to cook food.

When the matches become wet they become useless. Therefore, if an outdoors individual does not have another way to start a fire other than the through the use of a match, and all matches are wet, then that individual has no easy way to start a fire.

An old remedy for starting a fire is to use a flint. A flint is a hard rock which when struck against a roughened surface will create a spark. This spark can be utilized to start a fire.

An advantage of using a flint is that moisture does not affect its operability. Even if the striking surface and the flint become immersed in water, a quick drying of both the flint and the striking surface will permit the flint to be operated normally.

Knives of different types are commonly used by outdoorsmen. If a flint and a striking surface could be incorporated with a knife, such would definitely become a desirable tool to be available for usage by the outdoorsman if such is needed.

SUMMARY OF THE INVENTION

The structure of the present invention takes the form of utilizing a consumable flint stone fixedly mounted within a carrier rod. The inner end of this carrier rod includes a series of screw threads. This carrier rod is to be insertable within a storage chamber which substantially encloses the entire carrier rod and the flint. The inner end of this storage chamber also includes a series of screw threads which is to threadably connect with a series of screw threads on the carrier rod thereby fixing the carrier rod in position within the storage chamber. This storage chamber can be mounted within a pivotable blade of a pocket knife or can be fixedly positioned within the handle of a conventional exposed blade hunting knife. A striking surface, which usually takes the form of a serrated metalic surface is to be incorporated with the knife and it is upon this surface that the flint is to be struck in order to produce the desired spark.

The primary objective of the present invention is to increase the versatility of a conventional hunting knife by incorporating with the hunting knife a spark producing device to be utilized to start a fire.

Another objective of the present invention is to incorporate a spark producing device in conjunction with a knife which requires minor modification of the basic structure of the knife. The spark producing device can be incorporated during the manufacture of the knife at a relatively inexpensive price and therefore not significantly raising the cost of the knife to the ultimate consumer.

DETAILED DESCRIPTION OF THE SHOWN EMBODIMENT

Figure 1:
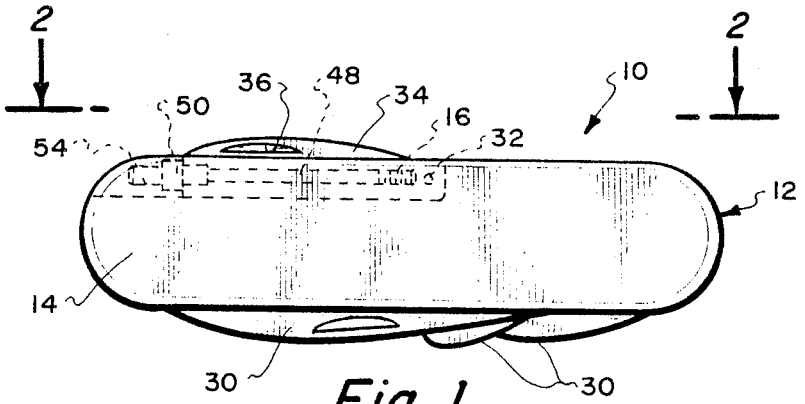
FIG. 1 is a side elevational view of a conventional pocket knife within which has been incorporated the spark producing device of the present invention with the pocket knife being shown in its typical to-be-stored position such as within a pocket of the individual's clothing.
Figure 2:
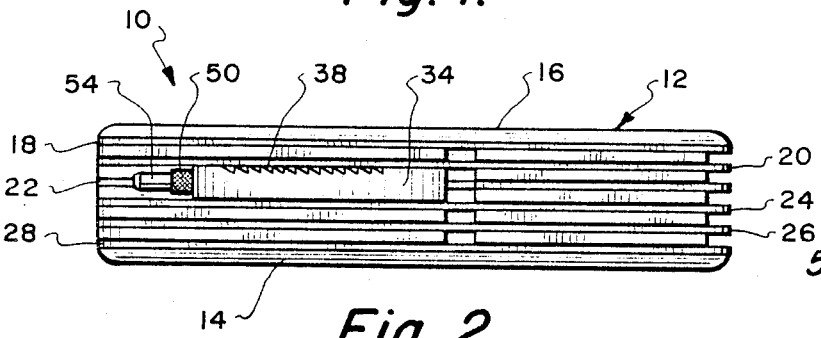
FIG. 2 is a top plan view of the pocket knife taken along line 2—2 of FIG. 1 showing the spark producing device of the present invention in the stowage position.
Figure 4:
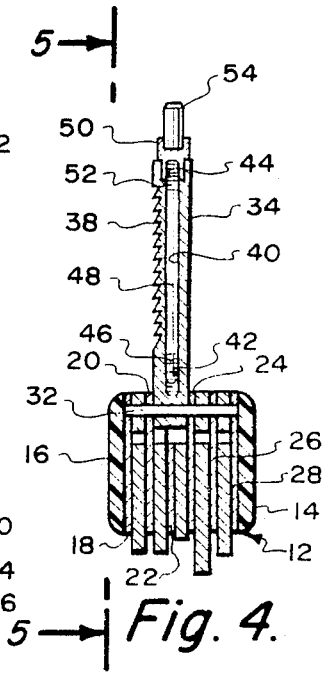
FIG. 4 is a cross-sectional view taken along line 4—4 of FIG. 3.
Figure 3:
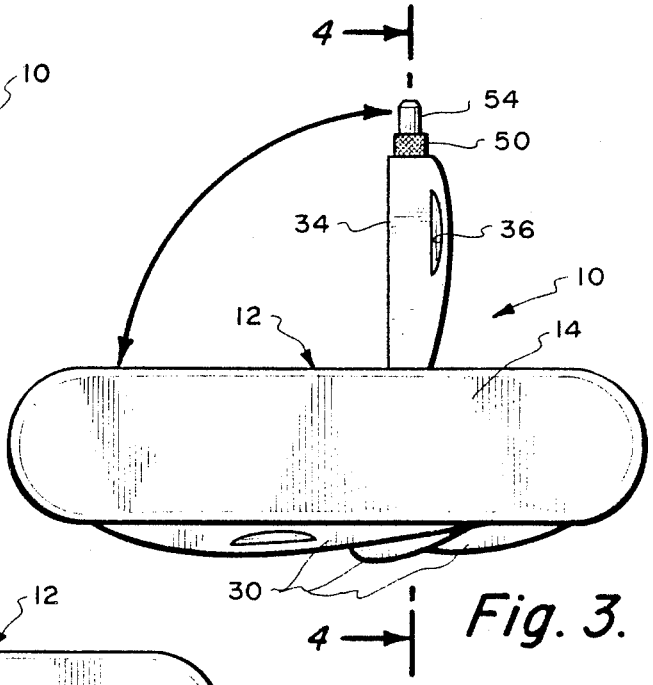
FIG. 3 is a side elevational view similar to FIG. 1, but showing the spark producing device in the extended, to-be-used, position.
Figure 5:
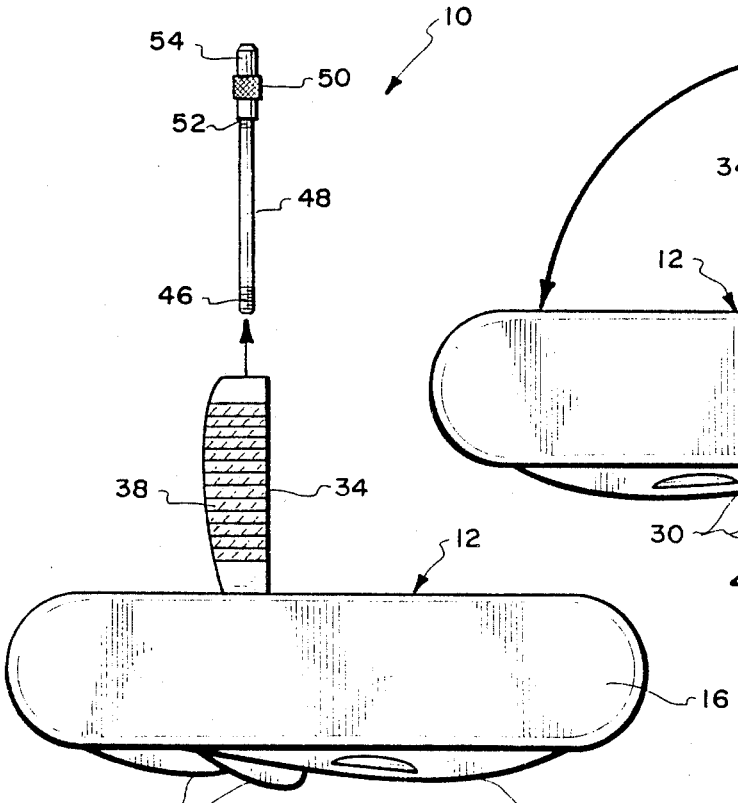
FIG. 5 is a side elevational view, taken along line 5—5 of FIG. 4, which is taken in a direction opposite to the view of FIG. 3 and showing the flint rod assembly disengaged from the blade within which it is stored which is required before it is to be used.

Referring particularly to the drawings, there is shown in FIGS. 1 to 6 a conventional pocket knife 10 which has a rigid housing 12 which constitutes the primary structural component of the pocket knife 10. The housing 12 is composed of a pair of oppositely faced identically sized side walls 14 and 16 which are fixedly connected together by pins (not shown). In between the side walls 14 and 16 are located a plurality of parallel located spacer plates 18, 20, 22, 24, 26 and 28. The size of each of the plates 18 through 28 are identical.

Located between each directly adjacent pair of plates 18 through 28 is a blade 30. These blades 30 are deemed to be conventional and form no specific part of this invention and are formed to include appropriate tools such as a knife blade, a screwdriver, a pair of scissors, tweezers, a nail cleaner, etc. Each of these blades 30 are to be totally movable from the extended position to the retracted position with the retracted position being clearly shown within the drawings. Each of these blades 30 are pivotally mounted on one of various pivot pins such as pivot pin 32.

Pivotally mounted on the pivot pin 32 is a blade 34. This blade 34 is movable between a retracted position, depicted in phantom lines in FIG. 1, and an extended position, shown in solid lines in FIG. 2 and which is shown in FIGS. 3 through 6. With the blade 34 in the retracted position, pocket knife 10 is designed to be carried in one's pocket during periods of non-usage of the pocket knife 10. During periods of usage, an individual is to insert a fingernail within recess 36 and pivot a blade 34 to the extended position which is about ninety degrees displaced from that in FIG. 1.

It is to be noted that the blade 34 is shown mounted by the pivot pin 32 which is located intermediate the ends of the pocket knife 10. In actual practice, the mounting blade 34 will in all probability be at an end of the pocket knife 10 and when the blade 34 is moved to its extended position, it is moved about one hundred eighty degrees, as such would be the normal operating position for a blade 30. The mounting of the blade 34 at an end of the pocket knife 10 makes the usage of the blade 34 easier than if mounted in the intermediate position shown in FIGS. 1 through 6.

The exterior surface of the blade 34 includes an abrasive surface such as in the form of a series of serrations 38. Serrated surface 38 is essentially identical to what would be found on a conventional file. The material of construction of the blade 34 would normally be that of a metallic material.

Included within the blade 34 is a storage chamber 40. The inner end of the storage chamber 40 includes a series of screw threads 42. The outer end of the storage chamber 40 is open-ended which is formed into enlarged annular recess 44. Threads 42 are to threadably connect with the threads 46 formed on the exterior surface of a carrier rod 48. Carrier rod 48 is solid. The outer end of the carrier rod 48 is threadably secured to a cap 50. Cap 50 includes a shoulder 52 which is to be matingly located within the enlarged annular recess 44. The main portion of the cap 50 is to rest against the outermost end of the blade 34. The exterior surface of the cap 50 will more than likely be knurled to facilitate manual pivoting (and disengagement) of the cap 50 from the carrier rod 48. Disengagement from the carrier rod 48 will normally be required for replacement of the flint 54. The flint 54 is a short cylindrical segment which has been fixedly mounted within the gap 50. When the flint 54 has been almost totally consumed, the cap 50 is to be disengaged from the carrier rod 48 and replaced with a new cap 50 upon which is located a new (unused) section of flint 54.

Figure 6:
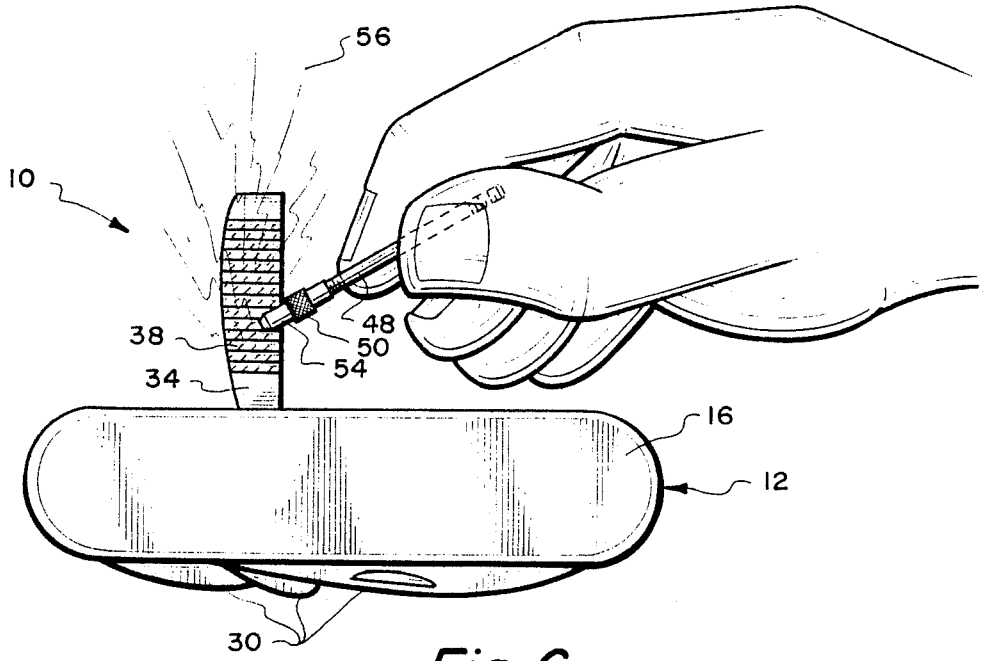
FIG. 6 is a view similar to FIG. 5, but showing the flint rod position being utilized to produce the desired spark.

When the blade 34 has been moved to the extended position, the operator is to grasp the knurled cap 50 and rotate such counterclockwise to threadably disengage threads 46 from the threads 42. At that time, the cap 50, flint 54 and the carrier rod 48 are to be removed from the storage chamber 40. The operator then, by holding of the carrier rod 48 as shown in FIG. 6, is to cause striking of the flint 54 against the serrated surface 38 producing sparks 56. It is these sparks 56 that are to be utilized to ignite a burnable material such as paper or dry leaves. When the desired combustion has occurred, the rod 48 is to be reinserted in the storage chamber 40 with a clockwise pivoting of the cap 50 to threadingly secure the threads 46 and 42 thereby fixing in position the rod 48 relative to the blade 34. Blade 34 can then be moved from the extended position to the retracted position shown in FIGS. 1 and 2.

Figure 7:
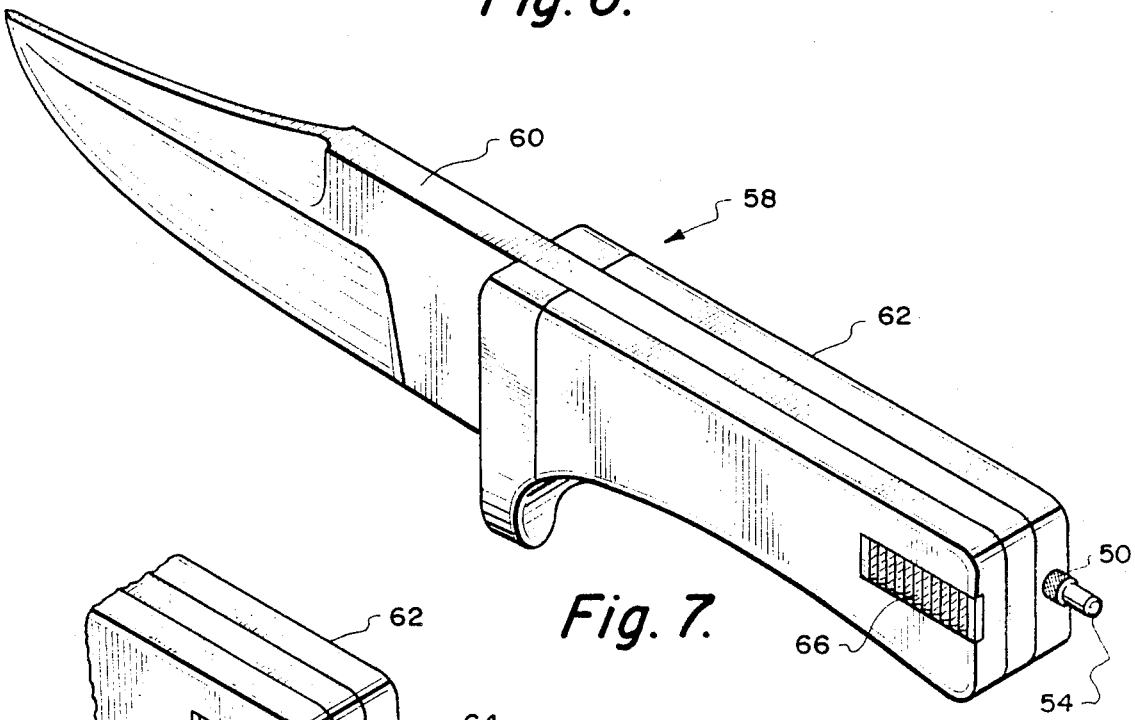
FIG. 7 is an isometric view of an exposed blade hunting knife within which has been incorporated the spark producing device of the present invention.
Figure 8:
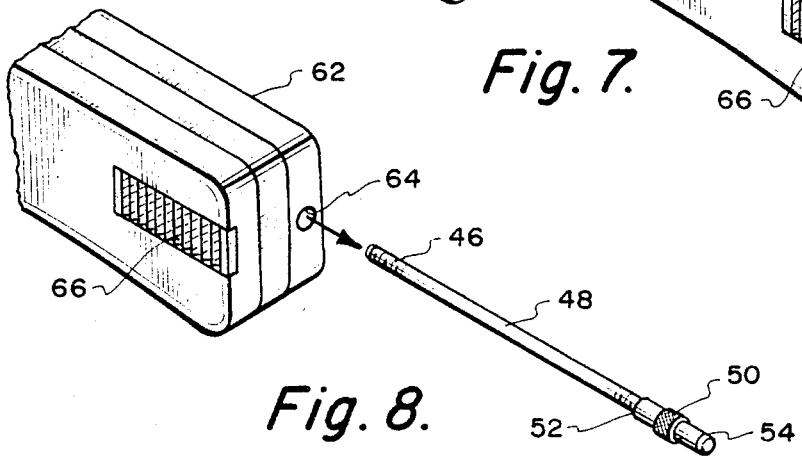
FIG. 8 is an isometric view of the rear portion of the handle of the hunting knife of FIG. 7 showing the flint rod assembly in a removed position from the handle.

In referring particularly to FIGS. 7 and 8 of the drawings, there is shown a knife 58 which has an exposed knife blade 60. The knife blade 60 is fixedly mounted within a handle 62. Within that handle 62 is located an internal opening 64. Within that internal opening 64 is to be mounted the carrier rod 48. It is to be understood that the inner end of the opening 64 is to be threaded together in a manner similar to the threaded connection by threads 42. In this manner, the carrier rod 48 is to be retained in the storage position as shown in FIG. 7 within the handle 62.

In order to use the flint 54, the operator rotates the knurled cap 50 in a counterclockwise direction thereby threadably disengaging the carrier rod 48 from the handle 62. The operator then utilizes the carrier rod 48 in a manner similar to that shown in FIG. 6 except causing the flint 54 to be struck against serrated metallic striking surface 66 formed within the exterior surface of the handle 62. Upon the flint 54 again being utilized to produce the desired spark 56, the carrier rod 48 is replaced within the opening 64 and the cap 50 rotated clockwise to threadably secure the carrier rod 48 to the handle 62.

What is claimed is:

1. In combination with a knife, said knife having a housing, said housing being capable of functioning as a graspable handle, spark producing means mounted in conjunction with said handle, said spark producing means comprising:

a flint rod assembly, said flint rod assembly including a flint;

a storage chamber, said flint rod assembly being connectable with said storage chamber, said flint rod assembly being substantially totally confineable with said storage chamber, said flint rod assembly being removable from said storage chamber;

a striking surface carried by said handle, said flint to be manually moved against said striking surface to produce a spark which is utilized to start a fire;

said flint rod assembly including a carrier rod, said flint being mounted within said carrier rod; and said carrier rod having an inner edge, said inner edge being threaded, said carrier rod to be threadably secured to said storage chamber when said carrier rod is totally confined within said storage chamber.

2. The combination as defined in claim 1 wherein: said striking surface comprising a serrated surface.

3. The combination as defined in claim 2 wherein: said storage chamber being mounted within a blade, said blade being pivotably mounted relative to said handle.

4. The combination as defined in claim 2 wherein: said storage chamber being mounted directly within said handle.

* * * * *